United States Patent [19]

Elms

[11] 4,103,209

[45] Jul. 25, 1978

[54] ADD-ON INSTANT RESTRIKE DEVICE FOR AN HID LAMP

[75] Inventor: Robert T. Elms, Monroeville, Pa.

[73] Assignee: Westinghouse Electric Corp., Pittsburgh, Pa.

[21] Appl. No.: 800,662

[22] Filed: May 26, 1977

[51] Int. Cl.[2] ..... H05B 41/04

[52] U.S. Cl. ..... 315/207; 315/243; 315/DIG. 7

[58] Field of Search ..... 315/207, 243, DIG. 7

[56] References Cited

U.S. PATENT DOCUMENTS 3,732,460 5/1973 Wattenbach ..... 315/243 X

*Primary Examiner*—Alfred E. Smith

*Assistant Examiner*—Charles F. Roberts

*Attorney, Agent, or Firm*—R. S. Lombard

[57] ABSTRACT

An "add-on" instant restrike device for a high-intensity discharge lamp ballast. The device initiates an operating discharge in an HID lamp when it is still hot from previous operation. The device consists of a high-voltage pulse-generating section which initiates breakdown in the lamp and an intermediate-voltage generating section which coacts with the existing ballasting capacitor to apply an intermediate potential to the lamp after initial breakdown. The intermediate potential has sufficient duration to permit one of the lamp electrodes to form an operating hot spot thereon to establish stable lamp operation.

2 Claims, 1 Drawing Figure

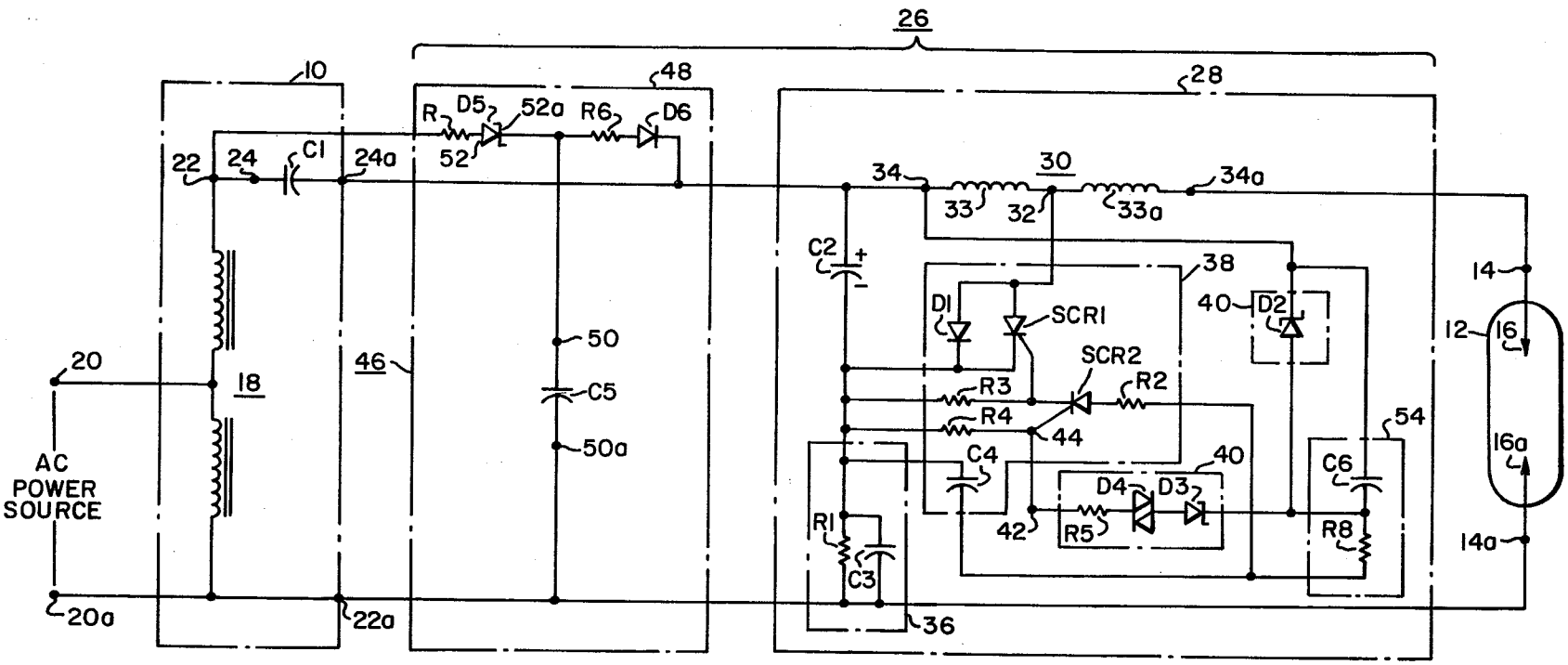
AC POWER SOURCE
SCR1
SCR2
D1
D2
D3
D4
D5
D6
R1
R2
R3
R4
R5
R6
R8
C1
C2
C3
C4
C5
C6

ADD-ON INSTANT RESTRIKE DEVICE FOR AN HID LAMP

BACKGROUND OF THE INVENTION

This invention relates to ballasts for HID lamps and particularly those ballasts designed to provide instant restrike capability to an HID lighting installation. An HID lamp utilizing a ballast without instant restrike capability requires a delay of 5 to 15 minues in order to restrike when it is hot. Such a delay is an obvious safety problem and an inconvenience for both outdoor and indoor lighting applications.

In U.S. Pat. No. 3,732,460 dated May 8, 1973 issued to Wattenback is disclosed a circuit for instant restart of a high pressure discharge lamp. The circuit uses a current limiting inductor, a power factor correcting capacitor, and an igniter for kilovolt, radio-frequency pulses. The circuit as shown is quite expensive.

SUMMARY OF THE INVENTION

It has been found that a simple and inexpensive add-on instant restrike device can be added to a conventional regulated output ballast for a high-intensity discharge lamp for initiating an operating discharge in a lamp when it is still hot from previous operation. The device comprises a high-voltage pulse-generating means connected across the normal ballast output terminals. The pulse-generating means comprises autotransformer means, gate-controlled solid-state switching means, voltage responsive conduction means and storage capacitor means. When the pulse-generating means is energized the storage capacitor means has applied across it an increasing potential which causes the voltage responsive conduction means to conduct when a predetermined value of voltage is applied across the storage capacitor means. When the voltage responsive conduction means conducts the gate-controlled solid-state switching means is gated thereby discharging the storage capacitor means and generating a short duration high-voltage pulse across the autotransformer means and creating through the high-intensity discharge lamp an ionized discharge path.

The add-on instant restrike device also comprises intermediate voltage generating means which coacts with the conventional ballasting capacitor means for applying an intermediate potential across the lamp electrodes after initial breakdown of the lamp. The intermediate voltage generating means comprises charging means for charging the ballasting capacitor means. When the ballast is energized while the lamp is still hot the storage capacitor means charges while the ballasting capacitor means charges to an intermediate voltage. When the storage capacitor means is discharged, there is created through the lamp an ionized discharge path which permits the ballasting capacitor means to discharge through the lamp and form an operating hot spot on one of the lamp electrodes which is adequate to permit sustained operation of the lamp.

BRIEF DESCRIPTION OF THE DRAWINGS

The invention can best be understood by reference to the accompanying drawing in which the sole FIGURE is a schematic diagram of the preferred embodiment.

DESCRIPTION OF THE PREFERRED EMBODIMENT

Referring to the sole FIGURE in which is shown a ballast 10 for a high-intensity discharge lamp 12 having two input terminals 14, **14*a* and two electrodes 16, 16*a* operatively disposed within the lamp. The lamp 12 as shown is a double ended 400 watt mercury vapor lamp. The ballast 10 includes a constant output voltage transformer 18 having transformer input terminals 20, 20*a* and transformer output terminals 22, 22*a*. The transformer input terminals 20, 20*a* are adapted to be connected to an AC power source. A ballasting capacitor means C1 has one terminal 24 connected to one of the transformer output terminals 22. The outer terminal 24*a* of the ballasting capacitor means C1 and the other of the transformer output terminals 22*a* constitute the normal ballast output terminals across which the terminals 14, 14*a* of the high-intensity discharge lamp 12** are normally adapted to be connected.

The improvement comprises an add-on instant restrike device 26 for initiating an operating discharge in the lamp 12 when it is still hot from previous operation. The instant restrike device 26 comprises high-voltage pulse-generating means 28 connected across the normal ballast output terminals **24*a*, 22*a*. the pulse-generating means 28 comprises autotransformer means 30 having a tap 32 defining the primary 33 and secondary 33*a* thereof and having a transformation ratio therebetween substantially greater than unity. The autotransformer means 30 is connected at its end portions 34, 34*a* in circuit between the other ballasting capacitor means terminal 24*a* and one of the lamp input terminals 14. Storage capacitor means C2 is connected in circuit across the normal ballast output terminals 24*a*, 22*a*. A storage capacitor charging network 36 comprising capacitor C3 and resistor R1 is connected between the storage capacitor C2 and one of the normal ballast output terminals 22*a*. Gate-controlled solid-state switching means 38 is connected between the tap 32 of the autotransformer means 30 and the storage capacitor means C2 to form a series loop comprising the primary 33 of the autotransformer means 30 and the storage capacitor means 36 and the switching means 38. The gate-controlled solid-state switching means 38 as shown comprise two silicon controlled rectifiers SCR1, SCR2, resistors R2, R3, R4, diode D1, and capacitor C4**.

First voltage responsive conduction means 40 is connected in circuit across the storage capacitor means C2. The voltage responsive conduction means has an output 42 connected to gate means 44 of the solid-state switching means 38. The first voltage responsive conduction means comprises zener diodes D2, D3, diac D4, and resistor R5. When the pulse-generating means 28 is energized the storage capacitor means C2 causes the voltage responsive conduction means 40 to conduct when a predetermined value of voltage is applied across the storage capacitor means C2 which gates the switching means 38 to discharge the storage capacitor means C2 through the series loop to generate a short duration, high-voltage pulse across the autotransformer means 30 and create through the high-intensity discharge lamp 12 an ionized discharge path. The magnitude of the pulse generated for the 400 watt mercury lamp shown in this embodiment is on the order of 20,000 volts occurring in a few microseconds.

The high-voltage short-duration pulse is insufficient in itself to reestablish normal operation within the lamp 12. An intermediate voltage of about 800 volts of longer duration following the pulse is necessary to keep the lamp 12 operational. The intermediate voltage generating means 46 coacts with the ballasting capacitor means C1 to charge the ballasting capacitor means C1 to an intermediate voltage through a plurality of half cycles of energizing potential when the ballast 10 is energized. The intermediate voltage generating means 46 comprises charging means 48 including a charging capacitor means C5 having one terminal 50 thereof in circuit with the one transformer output terminal 22. The other terminal **50*a* of the charging capacitor means C5 is connected to the other transformer output terminal 22*a*. The charging means 48 also includes a second voltage responsive conduction means D5 having an anode 52 and a cathode 52*a*. The anode 52 of the second voltage responsive conduction means D5 is connected to the one transformer output terminal 22. The cathode 52*a* of the second voltage responsive conduction means D5 is connected to said one terminal 50 of the charging capacitor means C5. When the ballast 10 is energized while the lamp 12 is still hot, the storage capacitor means C2 simultaneously charges while the ballasting capacitor means C1 charges to an intermediate voltage. When the storage capacitor means C2 discharges through the series loop, there is created through the lamp 12 an ionized discharge path which permits the ballasting capacitor means C1 to discharge through the lamp 12, for a sufficient period such as 200 microseconds form an operating hot spot on one of the lamp electrodes 16*a*, which is adequate to permit sustained operation of the lamp 12 thereafter. The intermediate voltage generating means as shown in the sole FIGURE also comprises resistors R6, R7 and diode D6**.

The high-voltage pulse-generating means 28 also desirably comprises phase shifting means 54 comprising resistor R8 and capacitor C6 connected in circuit with the first voltage responsive conduction means 40 to shift the voltage applied thereacross so that conduction by the first voltage responsive conduction means 40 occurs prior to the time the peak positive voltage occurs in the AC source. It has been found that if the high-voltage pulse occurs at the same time the AC source has a peak positive voltage the magnetics of the ballast 10 may prevent further operation of the lamp.

The table, below gives typical values for use in the circuit shown in the sole FIGURE.

TABLE

| Reference Identification | Component Value |
|---|---|
| C1 | Two 14.6 f, 300V AC Capacitors connected in parallel |
| C2 | 5 f, 400V DC, 180V AC |
| C3 | .05 f, 1000V |
| C4 | .47 f, 400V |
| C5 | .47 f, 600V |
| C6 | .5 f, 200V |
| D1, D6 | 1.5A, 1000V IN5393 |
| D2, D3 | 180V, 400MW IN991 |
| D4 | 40V Diac, Teccor Electronics, Inc. Part # GT40 |
| D5 | Three 200V, 1W IN3051 connected in series |
| R1 | 100K, 2W |
| R2 | 20 ohm, ¼ W |
| R3 | 2.7 ohm, ¼ W |
| R4 | 1K, ¼ W |
| R5 | 50 ohm, ½ W |
| R6, R7 | 15K, 2W |
| R8 | 10K, ½ W |
| SCR1 | 60A, 600V, Teccor Electronics, Inc. Part # S6006L |
| SCR2 | 1.6A, 400V, Teccor Electronics, Inc. Part # S4001L |

TABLE-continued

| Reference Identification | Component Value |
|---|---|
| 18 | H33, 400W Mercury Lamp Ballast, Westinghouse Electric Corp. Style # 5124D72G04 |
| 30 | Air Core Transformer, Primary 2 Turns, Secondary 100 Turns, Winding Material ⅞" × .005" Copper Foil, Winding Insulation 1½" × .002" Mylar Bobbin O.D. - 3" |
| 12 | H33, 400W Mercury Lamp, Westinghouse Electric Corp., Modified to have main electrodes terminated at opposite ends of the lamp structure |

In the circuit shown in the sole FIGURE, during steady state operation the ballasting capacitor means C1 acts as a current limiting impedance for the lamp 12 of about 100 ohms. When the lamp power is shut off and then reapplied the ballasting capacitor means C1 and the AC line voltage add to produce the intermediate potential necessary for hot-spot formation on the one lamp electrode **16*a* and to cause the lamp 12 to drop to a lower impedance operational state. The intermediate potential of about 800 volts occurs hundredths of a microsecond after the high-voltage pulse. During the restrike operation in the positive half-cycle C5 charges up through R7 and D5 positively. During the negative half-cycle C5 discharges through R6-D6 charging C1. C1 charges up towards 600 volts which is determined by the zener voltage of D5. As C1 is charged towards 600 volts, C2 is also charged towards 600 volts through R1. When C2 is charged to approximately 400 volts D2, D3 and D4 begin to conduct. When D2, D3 and D4 start to conduct D4 goes into a negative resistance mode and produces a large gate current turning SCR2 on. This produces a large current through the anode to cathode of SCR2 which then goes into the gate of SCR1 turning SCR1 into a highly conductive mode. When SCR1 conducts it applies a full 400 volts across C2 to the tap 32 on the autotransformer means 30. This voltage is then stepped up by the turns ratio of the autotransformer means 30 to produce the high-voltage short duration starting pulse necessary for initial breakdown of the lamp 12**.

During normal operation there is no DC voltage across C1 and therefore there is no DC voltage charging C2. The add-on instant restrike device 26 is basically out of the circuit, and makes no significant contribution to the AC operation. R7 and R6 limit the current through D5 and D6 in the steady state AC condition.

During the triggering of the high-voltage short duration pulse, full line voltage appears across the storage capacitor charging network 36 comprising R1 and C3. This causes a current to flow through C2 which, because of the nature of R1 and C3, is between 60° and 90° leading the voltage which appears across the network 36. This current going into C2 produces a voltage across C2 which is about 90° lagging the current, thereby making the total voltage across C2 about 0° to 30° lagging the AC line voltage. If the phase shifting means 54 composed of C6 and R8 were not in the circuit, the voltage responsive conduction means 40 would trigger at the peak voltage to C2, which would occur about 0° to 30° lagging the line voltage at its positive peak; however, the phase shifting means 54 produces a 60 ° leading voltage at the cathode side of D3, which produces the high-voltage short duration pulse 30° to 60° after the negative to positive 0 voltage crossing of the AC line voltage.

SCR2 is used to produce a very high gate current for SCR1. This is done because SCR1 conducts currents which are very high in terms of the steady-state ratings for the device. In essence SCR1 conducts a current which is on the order of 200 amps and the device is rated as a 6 amp device. The 200 amps though only occur for about 10 to 20 microseconds. it is best in terms of reliable operation to have a very high gate current with the device. SCR2 is used to produce that high gate current which occurs when SCR2 is triggered on when the voltage across D3 and D4 is about 220 volts. At that instant the voltage on C4 is about 220 V which is applied across R2 producing a device current through SCR2 of about 10 amps. This current is in essence all delivered into the gate of SCR1 thus producing the very high gate current required to instantly turn SCR1 to a full conducting mode. R3 and R4 prevent leakage currents from triggering SCR1 and SCR2 on.

When SCR1 is triggered on, C2 is charged plus to minus as shown in the sole FIGURE. This produces a positive current flowing through the primary 33 and the tap 32 of the autotransformer means 30 and through SCR1 and back to the negative side of C2. C2 and the primary of the autotransformer means 30 are highly resonant. In order to get the maximum use of the high-voltage pulse, C2 and primary 33 are permitted to resonate. D1 is included in the circuit to permit reverse current flow, thus permitting C2 and the primary 33 to produce a resonant damped high-voltage starting pulse.

I claim:

1. In combination with a ballast for a high-intensity discharge lamp having two input terminals and two electrodes operatively disposed within the lamp, said ballast including a constant output voltage transformer having transformer input terminals and transformer output terminals, said transformer input terminals adapted to be connected to an AC power source, and a ballasting capacitor means having one terminal connected to one of said transformer output terminals and the other terminal of said ballasting capacitor means and the other of said transformer output terminals constituting the normal ballast output terminals across which the terminals of said high-intensity discharge lamp are normally adapted to be connected, the improvement which comprises an add-on instant restrike device for initiating an operating discharge in said lamp when it is still hot from previous operation, said restrike device comprising:

(a) high-voltage pulse-generating means connected across said normal ballast output terminals, said pulse-generating means comprising autotransformer means having a tap defining the primary and secondary thereof and said autotransformer means connected at its end portions in circuit between said other ballasting capacitor means terminal and one of said lamp input terminals, storage capacitor means connected in circuit across said normal ballast output terminals, gate-controlled solid-state switching means connected between said tap of said autotransformer means and said storage capacitor means to form a series loop comprising the primary of said autotransformer means and said storage capacitor means and said switching means, and first voltage responsive conduction means connected in circuit across said storage capacitor means and having an output connected to gate means of said solid-state switching means, and when said pulse-generating means is energized said storage capacitor means has applied thereacross an increasing potential which causes said first voltage responsive conduction means to conduct when a predetermined value of voltage is applied across said storage capacitor means which gates said switching means to discharge said storage capacitor means through said series loop to generate a short duration high-voltage pulse across said autotransformer means and create through said high-intensity discharge lamp an ionized discharged path;

(b) intermediate voltage generating means which coacts with said ballasting capacitor means to charge said ballasting capacitor means to an intermediate voltage through a plurality of half cycles of energizing potential when said ballast is energized, said intermediate voltage generating means comprising charging means including a charging capacitor means having one terminal thereof in circuit with said one transformer output terminal and the other terminal thereof connected to said other transformer output terminal, second voltage responsive conduction means having an anode and a cathode, said anode of said second voltage responsive conduction means connecting to said one transformer output terminal and said cathode of said second voltage responsive conduction means connecting to said one terminal of said charging capacitor means, whereby when said ballast is energized while said lamp is still hot, said storage capacitor means charges while said ballasting capacitor means simultaneously charges to an intermediate voltage, and when said storage capacitor means is discharged through said loop, there is created through said lamp an ionized discharge path which permits said ballasting capacitor means to discharge through said lamp and form an operating hot spot on one of said lamp electrodes which is adequate to permit sustained operation of said lamp thereafter.

2. The ballast of claim 1, wherein said high-voltage pulse generating means also comprises phase shifting means connected in circuit with said first voltage responsive conduction means to shift the voltage applied thereacross so that conduction by said first voltage responsive conduction means occurs prior to the time the maximum positive voltage occurs in said AC source.

* * * * *